US010266907B2

(12) United States Patent
Guthrie et al.

(10) Patent No.: US 10,266,907 B2
(45) **Date of Patent: *Apr. 23, 2019**

(54) SYSTEM AND METHOD OF MAKING A CAST PART

(71) Applicant: Ford Motor Company, Dearborn, MI (US)

(72) Inventors: Bradley D. Guthrie, Livonia, MI (US); Venkat Nara, Northville, MI (US); Paul Harrison, Temperance, MI (US); Ronald H. Hasenbusch, Grosse Pointe Park, MI (US)

(73) Assignee: Ford Motor Company, Dearborn, MI (US)

( * ) Notice: Subject to any disclaimer, the term of this patent is extended or adjusted under 35 U.S.C. 154(b) by 189 days.

This patent is subject to a terminal disclaimer.

(21) Appl. No.: 15/592,572

(22) Filed: May 11, 2017

(65) Prior Publication Data

US 2017/0247775 A1 Aug. 31, 2017

Related U.S. Application Data

(63) Continuation of application No. 13/661,793, filed on Oct. 26, 2012, now Pat. No. 9,669,459.

(51) Int. Cl.
*C21D 9/00* (2006.01)
*B22D 29/00* (2006.01)
(Continued)

(52) U.S. Cl.
CPC ..... *C21D 9/0068* (2013.01); *B22D 17/002* (2013.01); *B22D 17/08* (2013.01); *B22D 17/2007* (2013.01); *B22D 17/2236* (2013.01); *B22D 17/32* (2013.01); *B22D 29/00* (2013.01); *B22D 30/00* (2013.01); *C21D 1/58* (2013.01);
(Continued)

(58) Field of Classification Search
CPC .. B22D 17/002; B22D 17/08; B22D 17/2007; B22D 17/2236; B22D 17/32; B22D 29/00; B22D 30/00; C21D 1/58; C21D 1/60; C21D 1/667; C21D 1/673; C21D 9/0062; C21D 9/0068; F02F 2200/06; F02F 7/0021; F02F 7/0053
See application file for complete search history.

(56) References Cited

U.S. PATENT DOCUMENTS 3,522,838 A 8/1970 Ott
5,753,280 A 5/1998 Coxhead
(Continued)

FOREIGN PATENT DOCUMENTS

CN 2442774 Y 8/2001
CN 1483847 A 3/2004
(Continued)

OTHER PUBLICATIONS

Alan A. Luo, et al., Advanced Casting Technologies for lightweight automotive applications, General Motors Global Research and Development Center, Warren, MI 48090, USA, The 69th WFC Paper, Nov. 2010.

*Primary Examiner* — Jenny R Wu
(74) *Attorney, Agent, or Firm* — Ray Coppiellie; Brooks Kushman P.C.

(57) ABSTRACT

A system and method of making a part. The part may cast in a die. A gripper assembly may be provided that has a gripper and a spray nozzle that provides a fluid. The part may be quenched with a fluid when the part is in the die.

11 Claims, 2 Drawing Sheets

(51) Int. Cl.

| | |
|---|---|
| ***B22D 17/20*** | (2006.01) |
| ***B22D 30/00*** | (2006.01) |
| ***B22D 17/00*** | (2006.01) |
| ***B22D 17/08*** | (2006.01) |
| ***B22D 17/22*** | (2006.01) |
| ***B22D 17/32*** | (2006.01) |
| ***C21D 1/58*** | (2006.01) |
| ***C21D 1/60*** | (2006.01) |
| ***C21D 1/667*** | (2006.01) |
| ***C21D 1/673*** | (2006.01) |
| ***F02F 7/00*** | (2006.01) |

(52) U.S. Cl.

CPC ..... *C21D 1/60* (2013.01); *C21D 1/667* (2013.01); *C21D 1/673* (2013.01); *C21D 9/0062* (2013.01); *F02F 7/0021* (2013.01); *F02F 7/0053* (2013.01); *F02F 2200/06* (2013.01)

(56) References Cited

U.S. PATENT DOCUMENTS

| | | | |
|---|---|---|---|
| 6,074,501 | A | 6/2000 | Baxter et al. |
| 6,224,693 | B1 | 5/2001 | Garza-Ondarza et al. |
| 6,672,367 | B2 | 1/2004 | Crafton et al. |
| 2008/0173171 | A1 | 7/2008 | Brower et al. |
| 2009/0065170 | A1 | 3/2009 | Vais et al. |
| 2009/0133849 | A1 | 5/2009 | Bakke et al. |
| 2010/0224289 | A1 | 9/2010 | Wang et al. |
| 2010/0224290 | A1 | 9/2010 | Idegomori et al. |

FOREIGN PATENT DOCUMENTS

| | | | |
|---|---|---|---|
| CN | 1951605 | A | 4/2007 |
| CN | 101010156 | A | 8/2007 |
| CN | 101066555 | A | 11/2007 |
| CN | 201906808 | U | 7/2011 |
| CN | 202291340 | U | 7/2012 |
| JP | 2009255118 | A | 11/2009 |

SYSTEM AND METHOD OF MAKING A CAST PART

CROSS-REFERENCE TO RELATED APPLICATIONS

This application is a continuation of U.S. application Ser. No. 13/661,793, filed Oct. 26, 2012, now U.S. Pat. No. 9,669,459, the disclosure of which is hereby incorporated in its entirety by reference herein.

TECHNICAL FIELD

This application relates to a system and method of making and quenching a cast part.

BACKGROUND

A system and method for heat treating castings is disclosed in U.S. Pat. No. 6,672,367.

SUMMARY

In at least one embodiment, a method of making a cast part is provided. The method may include casting a part in a die unit, opening the die unit, and positioning a gripper assembly having a gripper and a spray nozzle proximate the part. The part may be quenched with a fluid that is provided by the spray nozzle when the part is in the die unit.

In at least one embodiment, a method of making a part is provided. The method may include casting a part in a die unit, opening the die unit, and positioning a gripper assembly. The gripper assembly may have a gripper and a spray nozzle that sprays a fluid. The part may be grasped with the gripper and sprayed with the fluid while the part is in a die of the die unit. Spraying of the part may be terminated after removing the part from the die.

In at least one embodiment, a system for quenching a casting is provided. The system may include a die, a fluid source, and a manipulator. The die may provide the casting. The fluid source may provide a fluid. The manipulator may have a gripper assembly that includes a gripper and a spray nozzle that receives the fluid from the fluid source. The spray nozzle may spray the fluid onto the casting to quench the casting when the casting is in the die.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
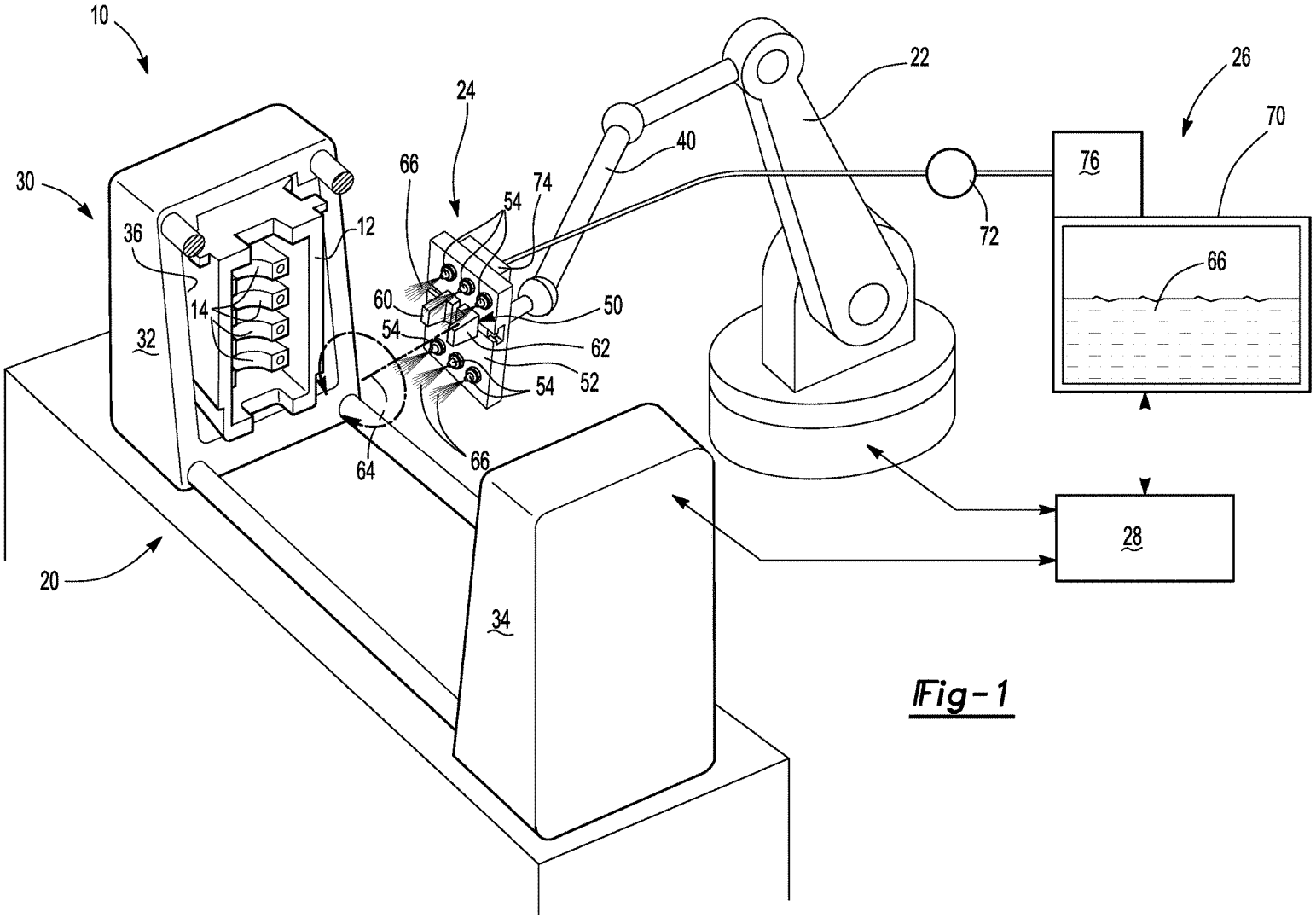
FIG. 1 is an exemplary system for making a part.

Referring to FIG. 1, a system 10 for making a part 12 is shown. The part 12 may be a cast part or casting. In FIG. 1, the part 12 is configured as a cylinder block or engine block for an internal combustion engine, such as may be provided in a motor vehicle like a car or truck. A part 12 that is configured as a cylinder block or engine block may have one or more bearing surfaces 14. A bearing surface 14 may be configured to support or engage a bearing that may support a moveable engine component, such as a crank shaft. The part 12 may be made of any suitable material, such as a metal or metal alloy. For instance, the part 12 may be made of a die cast aluminum alloy.

The system 10 may include a die casting machine 20, a manipulator 22, a gripper assembly 24, a pressurized fluid supply system 26, and a control system 28.

The die casting machine 20 may be configured to cast or form the part 12. The die casting machine 20 may include a die unit 30 having a first die 32 and a second die 34 that may cooperate to define a cavity 36 that may define the desired shape the part 12. Molten material or molten metal may be injected through the first die 32 or second die 34 and into the cavity 36 in a manner known by those skilled in the art. At least one of the dies may move with respect to the other die. For example, the first die 32 may be stationary while the second die 34 may be configured to move with respect to the first die 32 in one or more embodiments. In such a configuration, the second die 34 may be coupled to an actuator, such as a hydraulic actuator, that may be used to actuate the second die 34 toward and away from the first die 32. More specifically, the second die 34 may move between a closed position in which the second die 34 engages the first die 32 and an open position in which the first and second dies 32, 34 are spaced apart from each other to permit removal of the part 12.

The manipulator 22 may be configured to position the gripper assembly 24. For example, the manipulator 22 may include an articulated arm 40 upon which the gripper assembly 24 may be disposed. The manipulator 22 may have any suitable configuration. In at least one embodiment, the manipulator 22 may be configured as a robot or robotic manipulator and may be adjustable or moveable in multiple directions and along or about multiple axes, thereby providing multiple degrees of freedom.

The gripper assembly 24 may be an end effector that may be coupled to the arm 40. The gripper assembly 24 may include a gripper 50, a mounting plate 52, and at least one spray nozzle 54.

The gripper 50 may be configured to grasp the part 12. In at least one embodiment, the gripper 50 may include a first gripper portion 60 and a second gripper portion 62. The gripper 50 may move between an open position and a closed position. In the open position, the first and second gripper portions 60, 62 may be disposed further apart than when in the closed position. A gripper actuator, such as an electrical, pneumatic, or hydraulic actuator, may be provided to actuate the first and/or second gripper portions 60, 62 to facilitate movement between the open and closed positions. In at least one embodiment, the gripper 50 may be rotatable with respect to the mounting plate 52 and/or at least one spray nozzle 54. For example, the gripper 50 may be configured to rotate about an axis of rotation 64 that may extend between the first and second gripper portions 60, 62.

The mounting plate 52 may be coupled to the manipulator 22. In at least one embodiment, the mounting plate may 52 be fixedly disposed on the manipulator 22 and may be configured to receive or facilitate mounting of at least one spray nozzle 54. As such, the mounting plate 52 may not rotate about the axis of rotation 64 with the gripper 50 in one or more embodiments.

One or more spray nozzles 54 may be provided to spray a fluid 66, such as a liquid die lubricant or water, onto the part 12. In the embodiment shown in FIG. 1, multiple spray nozzles 54 are provided. The spray nozzles 54 may be disposed on at least one component of the gripper assembly 24. For example, a spray nozzle 54 may be fixedly disposed on the mounting plate 52. The spray nozzles 54 may be configured to spray the fluid 66 in a predetermined pattern to target a specific feature or region of the part 12, such as the bearing surface 14.

The pressurized fluid supply system 26 may be configured to provide the fluid 66 to at least one spray nozzle 54. In at least one embodiment, the pressurized fluid supply system 26 may include a fluid source 70, a control valve 72, and a manifold 74. Each of these components may be fluidly connected to at least one other component via a conduit, such as a hose, tubing, pipe, or combinations thereof. In FIG. 1, the routing of such conduits is simplified for clarity.

The fluid source 70 may be configured to supply or store a volume of the fluid 66. For example, the fluid source 70 may be a tank or reservoir. The fluid source may 70 may include or may be coupled to a pump 76 that may pressurize the fluid 66 to facilitate delivery to the manifold 74 and spray nozzles 54.

The control valve 72 may enable or disable the flow of the fluid 66 from the fluid source 70 to the spray nozzle 54. Operation of the control valve 72 may be controlled by the control system 28. For instance, the control valve 72 may include or may be controlled by an actuator, such as solenoid, that may actuate the control valve 72 between an open position and a closed position. In the open position, the fluid 66 may flow from the fluid source 70 to the spray nozzles 54. In the closed position, the fluid 66 may be inhibited from flowing from the fluid source 70 to the spray nozzles 54. The control valve 72 may be normally closed under predetermined operating conditions, such as when the system 10 is not operational or turned off or when the gripper assembly 24 and spray nozzles 54 are not in a desired position.

The manifold 74 may be fluidly coupled to the fluid source 70 via the control valve 72. In addition, the manifold 74 may be fluidly coupled to the spray nozzles 54. More specifically, the manifold 74 may have an inlet that receives the fluid 66 and a plurality of outlets. Each outlet may be fluidly coupled to at least one spray nozzle 54 via a conduit, such as a hose, tubing, pipe, or combinations thereof. As such, the manifold 74 may distribute the fluid to multiple spray nozzles 54.

The control system 28 may monitor and control operation of the system 10. For example, the control system 28 may include at least one controller or control module that monitors and/or controls various components of the system 10, such as operation of the die casting machine 20, manipulator 22, gripper assembly 24, and/or pressurized fluid supply system 26.

Figure 2:
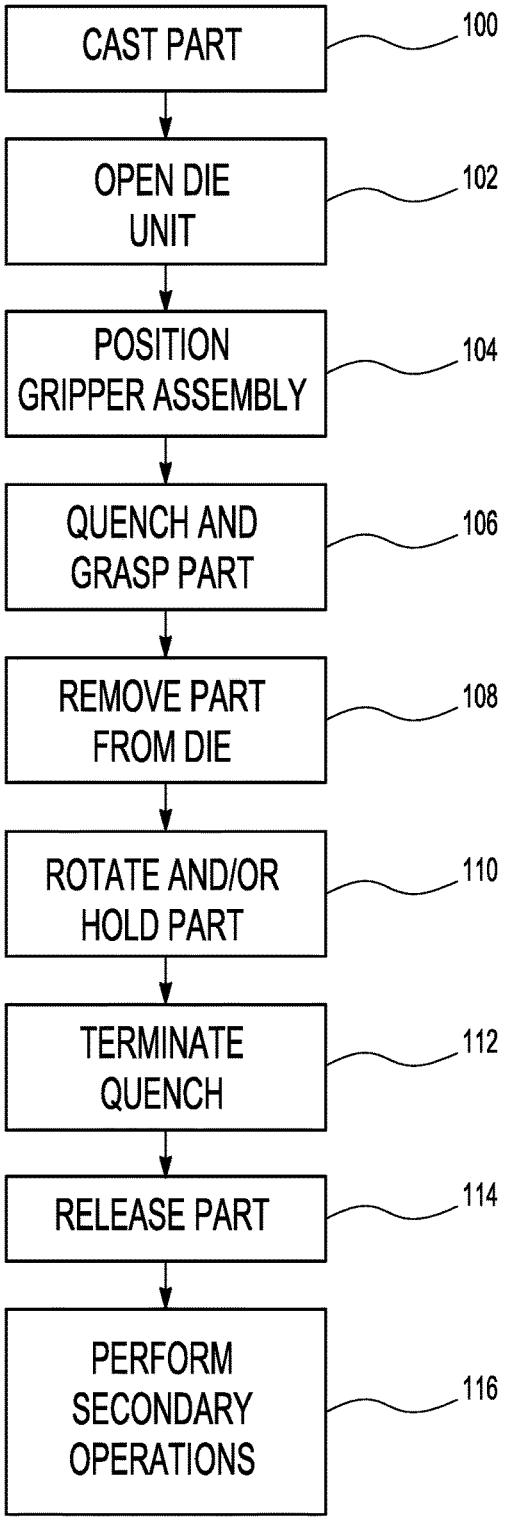
FIG. 2 is a flowchart of a method of making a part.

Referring to FIG. 2, a flowchart of an exemplary method of making a part 12 is shown. The method may be performed with the system 10. As will be appreciated by one of ordinary skill in the art, the flowchart may represent or include control logic which may be implemented or affected in hardware, software, or a combination of hardware and software. For example, the various functions may be affected by a programmed microprocessor. The control logic may be implemented using any of a number of known programming and processing techniques or strategies and is not limited to the order or sequence illustrated. For instance, interrupt or event-driven processing may be employed in real-time control applications rather than a purely sequential strategy as illustrated. Likewise, parallel processing, multitasking, or multi-threaded systems and methods may be used.

Control logic may be independent of the particular programming language, operating system, processor, or circuitry used to develop and/or implement the control logic illustrated. Likewise, depending upon the particular programming language and processing strategy, various functions may be performed in the sequence illustrated, at substantially the same time, or in a different sequence while accomplishing the method of control. The illustrated functions may be modified, or in some cases omitted, without departing from the spirit or scope intended. In at least one embodiment, the method may be executed by the control system 28 and may be implemented as a closed loop control system.

At 100, the method may begin by casting the part 12. Casting the part 12 may include spraying the portions of the first and second dies 32, 34 that form the cavity 36 with a die lubricant to help control the die temperature and assist in the removal of the part 12. The first and second dies 32, 34 may be moved to the closed position and molten material may be injected into the cavity 36 and allowed to solidify in a manner known to those skilled in the art.

At 102, the die unit 30 may be opened. The die unit 30 may be opened by moving the first and/or second dies 32, 34 to the open position, thereby providing access to the part 12. After opening, the part 12 may be held in either the first die 32 or the second die 34. In addition, one or more cores or slides in the first and/or second dies 32, 34 may be retracted to facilitate removal of the part 12.

At 104, the gripper assembly 24 may be positioned. More specifically, the gripper assembly 24 may be positioned proximate the part 12 by operating the manipulator 22. Positioning of the gripper assembly 24 may be initiated before, during, or after the die unit 30 is opened.

At 106, the part 12 may be quenched and grasped. Quenching may be accomplished by spraying at least a portion of the part 12 with the fluid 66 to cool the part while the part 12 is held by or disposed in either the first die 32 or the second die 34. For instance, the control valve 72 may be opened to allow pressurized fluid 66 to flow from the fluid source 70 to the manifold 74 and spray nozzles 54. The part 12 may be grasped by actuating the gripper 50. For example, the gripper 50 may initially be in the open position. The manipulator 22 may position the gripper 50 such that at least a portion of the part 12 is located between the first and second gripper portions 60, 62. The gripper 50 may then be actuated to the closed position such that the first and second gripper portions 60, 62 may clamp and grasp the part 12 between the first and second gripper portions 60, 62. Quenching and grasping may occur at approximately the same time. For example, quenching may be initiated before the gripper 50 grasps or engages the part 12, at the same time that the gripper 50 engages the part 12, or immediately after the gripper 50 engages the part 12. In addition, quenching may target a specific region or surface of the part 12, such as one or more bearing surfaces 14.

At 108, the part 12 may be removed from the die unit 30. More specifically, the part 12 may be removed from the cavity 36 by moving the manipulator 22 to pull the part 12 out of the cavity 36. Removal of the part 12 may be assisted by actuating ejector pins that may be provided with a die 32, 34 to help push the part 12 out of the cavity 36. The part 12 may be spaced apart from the first and second dies 32, 34 after removal. Quenching of the part 12 may continue while the part is removed.

At 110, the part 12 may be rotated and or held for a predetermined amount of time. All or a portion of this step may be omitted in one or more embodiments. The part 12 may be rotated by rotating the gripper 50 about the axis of rotation 64 and with respect to the spray nozzles 54. Rotation of the part 12 may permits the fluid 66 to be sprayed on different surfaces or features of the part 12 or a greater surface area of the part 12. The part 12 may be held with the gripper 50 in a stationary and/or nonstationary manner or position to provide sufficient time to quench the part 12. In addition, the part 12 may be held over a basin to allow sprayed fluid 66 that is not vaporized to be collected and recycled.

At 112, quenching of the part 12 may be terminated. Quenching may be terminated by closing the control valve 72 and/or by turning off the pump 76. Quenching of the part 12 may be stopped or terminated based on the various attributes. For example, the part 12 may be quenched for a predetermined period of time to allow the part 12 to obtain desired material properties. In at least one embodiment, the part 12 may be quenched or cooled for approximately 6 to 15 seconds. The part 12 may also be quenched until the part 12 attains a predetermined temperature. For example, the part 12 may be quenched and cooled until the temperature of the part 12 is below 300° C. The predetermined temperature may be correlated with a predetermined quench time in one or more embodiments. The part 12 may also be quenched at a predetermined rate. For example, the part 12 may be cooled at a rate of at least 10° C. per second for a predetermined amount of time and/or until the part 12 obtains the predetermined temperature.

At 114, the part 12 may be released. The part 12 may be released by opening the gripper 50 or actuating the gripper 50 to the open position to allow the gripper 50 to disengage the part 12. The manipulator 22 may then move the gripper assembly 24 back to the initial position.

At 116, secondary operations may be performed on the part 12. Secondary operations may include trimming the part 12 to remove excess material, such as gates and sprues, and performing subsequent machining steps.

The system and method described herein may allow a casting or cast part to be manufactured without separate solution heat treating steps, such as reheating a batch of parts in a furnace to re-elevate the temperature of the part to its solution temperature followed by quenching the parts. Many die cast parts cannot undergo such solution heat treatment as the high heat level that is used to achieve the desired material properties will also blister the part. The system and method described herein allows the desired material properties to be obtained without blistering the part. As such, equipment costs such as for the furnace and associated material handling equipment as well as associated energy costs may be avoided. In addition, overall manufacturing time may be reduced due to the elimination of the solution heat treating steps.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A casting quenching system comprising:

a die that holds a casting;

a manipulator having a gripper assembly that includes a gripper and a spray nozzle; and a control system that controls the gripper assembly by grasping the casting with the gripper followed by quenching the casting with a fluid that is provided by the spray nozzle when the casting is in the die;

wherein the spray nozzle is spaced apart from the gripper and the gripper is rotatable about an axis of rotation with respect to the spray nozzle.

2. The system of claim 1 wherein the casting is removed from the die with the manipulator and the casting is quenched with the fluid while the casting is being removed from the die.

3. The system of claim 1 wherein the gripper assembly is disposed on an arm of the manipulator.

4. The system of claim 1 wherein the casting is a cylinder block.

5. The system of claim 4 wherein the cylinder block has a bearing surface and wherein the fluid is sprayed onto the bearing surface to cool the bearing surface.

6. The system of claim 1 wherein quenching the casting occurs immediately after grasping the casting with the gripper.

7. The system of claim 1 wherein quenching the casting cools the casting at a rate of at least 10° C./second.

8. The system of claim 1 wherein the fluid is a die lubricant.

9. The system of claim 1 wherein the fluid includes water.

10. A casting quenching system comprising:

a die unit within which a part is cast;

a gripper assembly that includes a spray nozzle and a gripper, the gripper being rotatable about an axis of rotation with respect to the spray nozzle; and a control system that controls the gripper assembly by grasping the par with the gripper and then spraying the part with a fluid while the part is in the die unit.

11. The system of claim 10 wherein spraying the part is terminated after the part is removed from the die unit.

* * * * *